US007312807B2

(12) United States Patent
Comas et al.

(10) Patent No.: US 7,312,807 B2
(45) Date of Patent: Dec. 25, 2007

(54) DEVICE FOR MAINTAINING AN EDGE OF A PRINT MEDIA AGAINST A PRINTING DRUM

(75) Inventors: Esteban Comas, Sant Quirze Del Valles (ES); Ismael Chanclón, Cornella de Llobregat (ES); Jorge Menendez, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 267 days.

(21) Appl. No.: 11/154,564

(22) Filed: Jun. 17, 2005

(65) Prior Publication Data

US 2006/0284961 A1 Dec. 21, 2006

(51) Int. Cl.
*B41J 11/00* (2006.01)
*B65H 5/12* (2006.01)
*B65H 5/14* (2006.01)

(52) U.S. Cl. ..... 346/138; 347/153; 347/264; 271/277

(58) Field of Classification Search ..... 346/134, 346/138

See application file for complete search history.

(56) References Cited

U.S. PATENT DOCUMENTS 4,111,119 A * 9/1978 Takizawa et al. ..... 101/127.1
4,390,176 A * 6/1983 Kato ..... 271/270
5,296,874 A * 3/1994 Nagata et al. ..... 347/218

* cited by examiner

*Primary Examiner*—Huan Tran

(57) ABSTRACT

The invention relates to a device for maintaining an edge of a print media against a printing drum, said drum comprising a surface on which a print media is wrapped for printing thereon, wherein said device comprises at least one holder which comprises an abutment portion against which an edge of the media abuts before or during wrapping of the media on the drum surface, the holder being adapted to bring an upstanding portion of the media into contact with the drum surface by performing a movement with respect to the drum surface between a media edge reception position and a media edge clamping position, the movement of the holder from said reception position to said clamping position being performed in such a way that as the holder approaches the clamping position the distance between the edge of the media and the abutment portion of the holder increases, or remains substantially the same, thereby allowing the media in its clamping position to be substantially flat on the drum surface.

14 Claims, 4 Drawing Sheets

DEVICE FOR MAINTAINING AN EDGE OF A PRINT MEDIA AGAINST A PRINTING DRUM

The present invention relates to a device for maintaining an edge of a print media against a printing drum. The invention further relates to a printing drum and a printing apparatus which are provided with such a device, and to a printing method.

In a printing apparatus of the type having a drum platen, i.e. a rotary drum around which a paper sheet or other print media is wound for printing on it, the sheets of paper may be held down on the drum surface by means of vacuum, electrostatic charges or other hold-down systems.

However, the leading and trailing edges of the print media tend to remain straight or curl upwards, instead of adopting the curvature of the drum, and thus may slightly project from the drum surface; this may occur to a larger extent with thick and thus relatively stiff print media.

If the edge of a sheet of print media, especially the leading edge of the sheet in the direction of rotation of the drum, remains raised with respect to the surface of the drum, there is a risk that during the rotation of the drum it may crash against the printhead of the printing apparatus, causing various problems such as ink smearing, print media jams, printhead damage, down times, and, in summary, poor reliability of the printing process and/or increased maintenance costs.

This problem arises e.g. in the case of an inkjet printing apparatus, because in such an apparatus it is desirable to keep the pen to paper spacing as small as possible in order to achieve a high printing quality.

In some known printing apparatus a clamping or gripping device is arranged on the drum in order to grip the leading edge of a sheet when it is loaded on the drum and keep it against the drum surface during printing.

An example of such device is known from U.S. Pat. No. 4,949,638 which discloses a clamping pawl operated to swing about a hinge axis between a clamping position in contact with the drum surface and a release position.

U.S. Pat. No. 4,627,754 discloses an L-shaped clip for clamping the leading edge of a sheet on a printing drum. A long leg of the clip is housed in a radial slot of the drum, and the clip may be displaced along the slot between a clamping and a release position.

Such devices have a drawback when employed in combination with a hold-down device as mentioned above: when the leading edge of the sheet abuts against the clamping or clipping device, which also constitutes a reference for the position of said leading edge, and the pawl or clip is moved to the clamping position, the edge of the sheet is pushed backwards by the pawl or clip itself.

Since the rest of the sheet is maintained in position on the drum by the hold-down device, the sheet may form a bulge. This has consequences in the printing quality, since the ink is deposited offset from the intended position due to the shape adopted by the sheet.

The present invention seeks to provide a device for maintaining the edge of a print media against the printing drum in which this drawback is at least reduced.

According to a first aspect, the present invention relates to a device for maintaining an edge of a print media against a printing drum, said drum comprising a surface on which a print media is wrapped for printing thereon, wherein said device comprises at least one holder which comprises an abutment portion against which an edge of the media abuts before or during wrapping of the media on the drum surface, the holder being adapted to bring an upstanding portion of the media into contact with the drum surface by performing a movement with respect to the drum surface between a media edge reception position and a media edge clamping position, the movement of the holder from said reception position to said clamping position being performed in such a way that as the holder approaches the clamping position the distance between the edge of the media and the abutment portion of the holder increases, or remains substantially the same, thereby allowing the media in its clamping position to be substantially flat on the drum surface.

Such a device allows printing on the print media white its edge is maintained against the drum and protected, and reducing at the same time the risk of bulges, wrinkles or the like in the media.

According to a second aspect, the present invention relates to a device for maintaining an edge of a print media against a printing drum, said drum comprising a surface on which a print media is wrapped for printing thereon, wherein said device comprises at least one holder which is movable with respect to the drum surface between a media edge reception position and a media edge clamping position, the movement of said holder from said reception position to said clamping position being performed in a direction which does not intersect the path of said media edge during said movement.

The invention also relates to a printing drum on which a print media is wrapped for printing thereon, said drum comprising a device according to the first aspect of the invention, for maintaining an edge of a print media against the drum surface.

The present invention also relates to a printing apparatus comprising a printing drum on which a print media is wrapped for printing thereon, said printing apparatus further comprising a device according to the first aspect of the invention for maintaining an edge of a print media against the drum.

The invention also relates to a printing method, comprising:

providing a printing drum and a holder for maintaining an edge of said print media against said drum;

feeding a print media to said printing drum while maintaining said holder in a media edge reception position, at least until an edge of said media abuts said holder;

causing said holder to move to a clamping position to bring an upstanding portion of the media into contact with the drum surface, said movement being performed in a linear direction which does not intersect the path defined by the edge of the media during the movement; and printing on said print media.

Particular embodiments of the present invention will be described in the following, only by way of non-limiting example, with reference to the appended drawings, in which.

Figure 1:
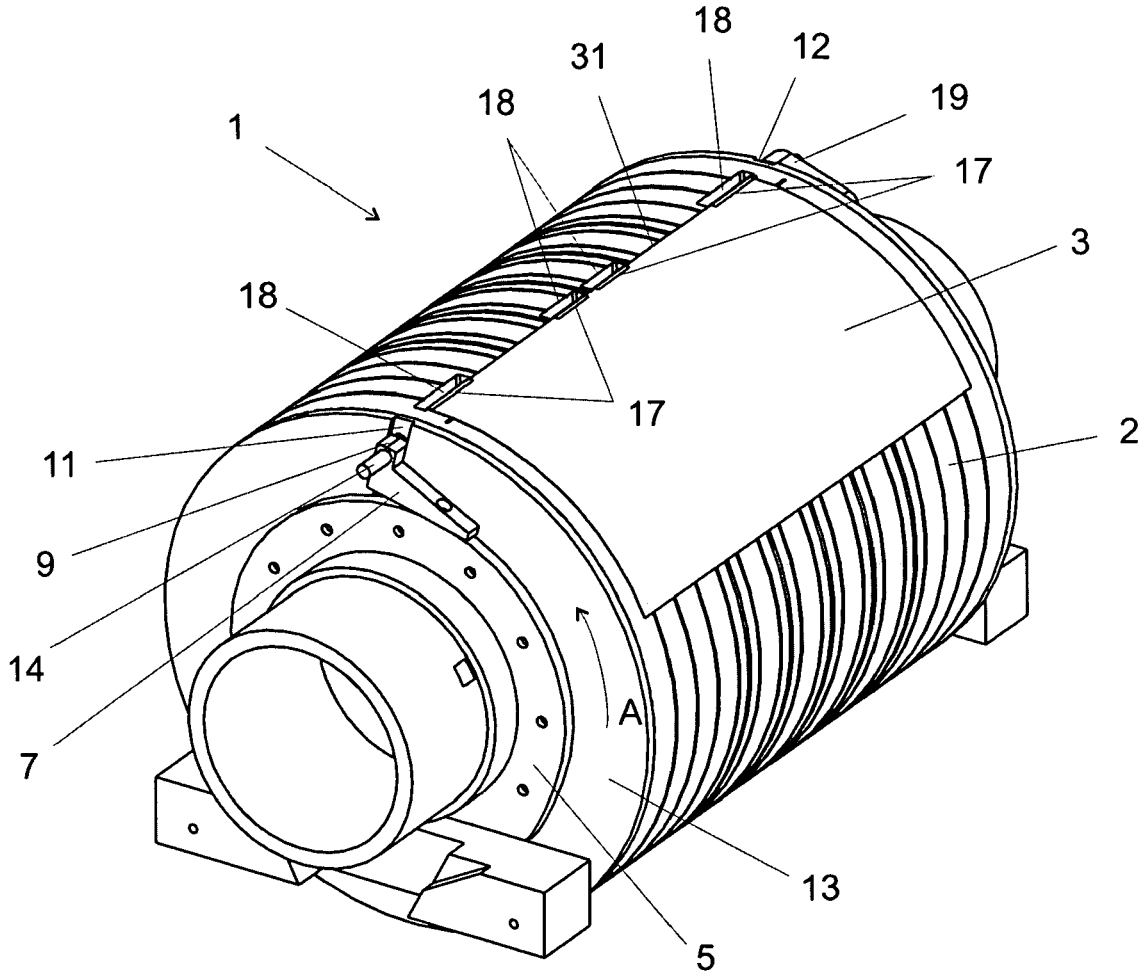
FIG. 1 is a perspective view showing a printing drum according to an embodiment of the present invention.

FIG. 1 shows a rotary printing drum 1 of a printing apparatus, said drum having a drum surface 2, on which a print media 3, such as paper, is wrapped for printing on it in a known manner, for example by means of inkjet or thermal printheads (not shown), when the rotation of the drum in the direction of the arrow A depicted in the figure brings the print media under the printhead or printheads.

The printing drum 1 is provided in known manner with a media hold-down system (not shown), which may for example operate by vacuum or by electrostatics, intended to maintain the print media in close contact with the surface 2 during printing. This system exerts a hold-down force on at least a portion of the sheet of media 3 other than the edges thereof; in general the force is exerted relatively evenly on most of the sheet surface.

In order to reduce the risk of poor printing quality and/or crashes of the edges of the print media 3, and particularly of the leading edge thereof 31, with the overlaying printheads, the printing drum of FIG. 1 has been provided with a device 4 (best seen in FIG. 2) for maintaining the edge of the print media against the surface of the drum. An embodiment of this device 4 will be described in the following, with reference to FIGS. 1 and 2.

Figure 2:
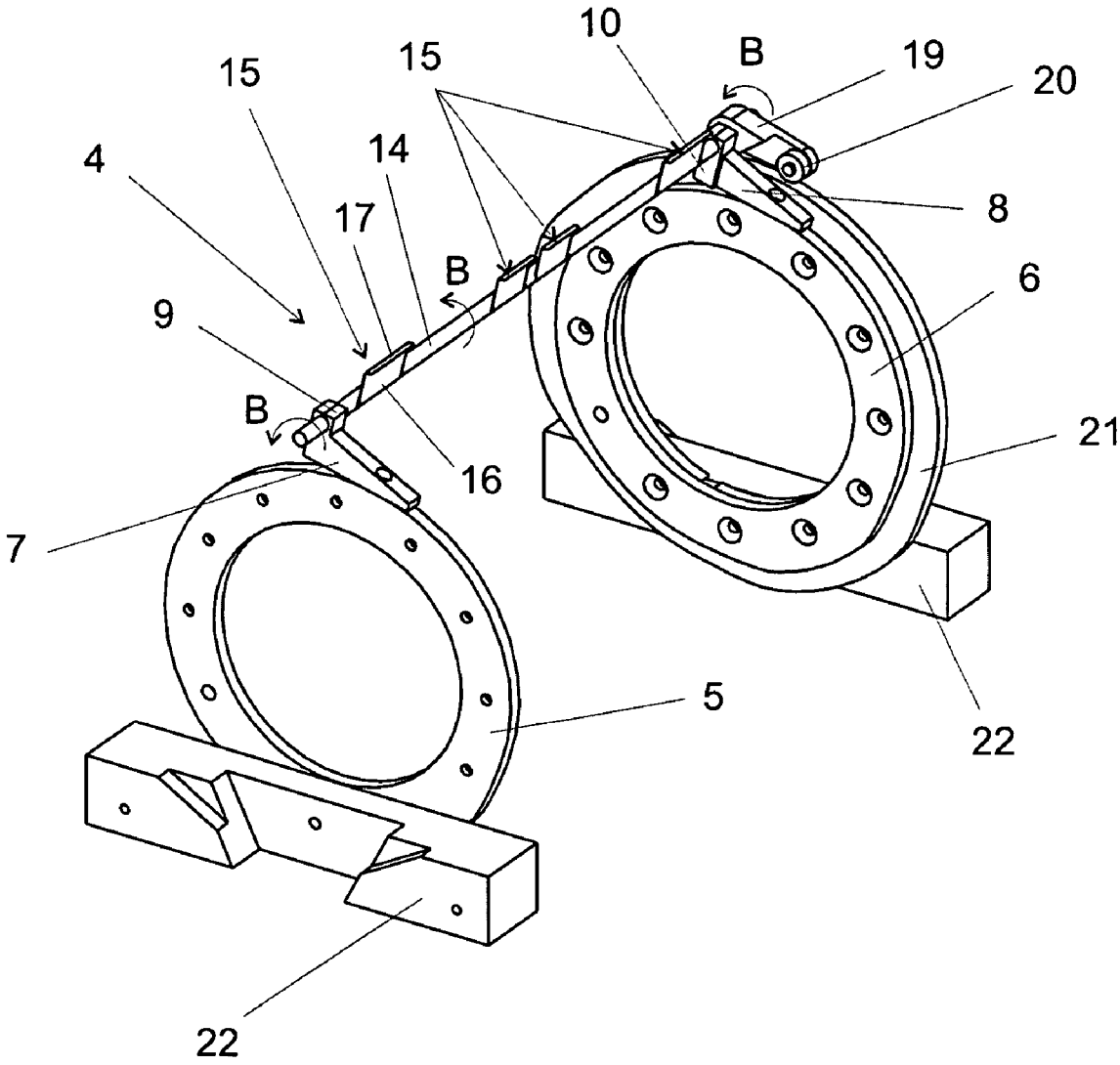
FIG. 2 is a perspective view showing the main elements of an embodiment of a device for maintaining an edge of a print media against a printing drum such as that of FIG. 1.

As shown in FIG. 2, where the printing drum itself has been removed, the device 4 for maintaining the edge of the print media comprises two twin cams 5 and 6, arranged stationary at the two ends of the printing drum and coaxial to the drum itself, on which ride two corresponding cam followers 7 and 8 which rotate together with the drum 1, as explained in the following.

Each cam follower 7,8 is attached to a sliding block 9,10 which projects from the side wall of the cam follower, each block being able to slide within a guide groove 11,12 formed on the side wall 13 of the drum 1 (FIG. 1). Thus, the cam followers 7,8 move up and down along the guide grooves 11,12 depending on the lobes defined by the surface of the cams 5,6, which have the same shape such that the two cam followers have the same movement.

The two sliding blocks 9,10 are joined together by a common shaft 14, which is journalled such as to be able to rotate with respect to the blocks. On the shaft 14 are mounted a number of L-shaped holders 15, four in this embodiment, each made up of a supporting plate 16 which is folded into a retaining lip 17 at its free end.

As best seen in FIG. 1, each holder 15 is received inside a recess 18 formed in the surface of the drum; the holders 15, followers 7,8 and twin cams 5,6 are dimensioned such that during the rotation of the drum the holders 15 are displaced between at least two different positions: a media edge reception position, in which the holders 15 project slightly from the surface of the drum 1 and are arranged to receive an edge 31 of the media 3 in abutment against their supporting plate 16 (see detail in FIG. 3), and a clamping position, in which the lip 17 of the holders 15 clips the edge 31 of the media 3 against the drum surface. The operation of the device will be explained in more detail further on.

Still referring to FIG. 2, the shaft 14 journalled in the two sliding blocks 9,10 projects from at least one of said blocks (block 10 in FIG. 2) and is anchored to a cam follower 19 provided with a wheel 20. This cam follower 19 rides on a stationary cam 21 which is arranged coaxial to the drum 1 and to the other cams 5,6.

When the cam follower 19 rides on a lobe of the cam 21, it causes pivoting of the shaft 14 of the device 4, such that the holders 15 are rotated in the direction shown by the arrows B in FIG. 2. The object of this rotation is to release the edge 31 of the media after printing, as will be explained below.

The cams 5,6 and 21 are attached to the structure 22 of the printing apparatus, and the shaft of the printing drum passes through said cams; the cam followers are kept in contact with the surface of their corresponding cams by any means known to the skilled man, such as springs.

The device 4 for maintaining the edge of the print media against the surface of the drum is shown in FIG. 2 with a single shaft 14 on which are mounted four holders 15; however, in other embodiments further shafts and holders can be provided about the surface of the drum 1, which will then be provided with corresponding recesses for receiving the holders and guide grooves for the cam followers. The distance between the shafts about the drum surface and the distance between the holders on each shaft will be selected depending on the media formats to be handled on the printing drum.

Figure 3:
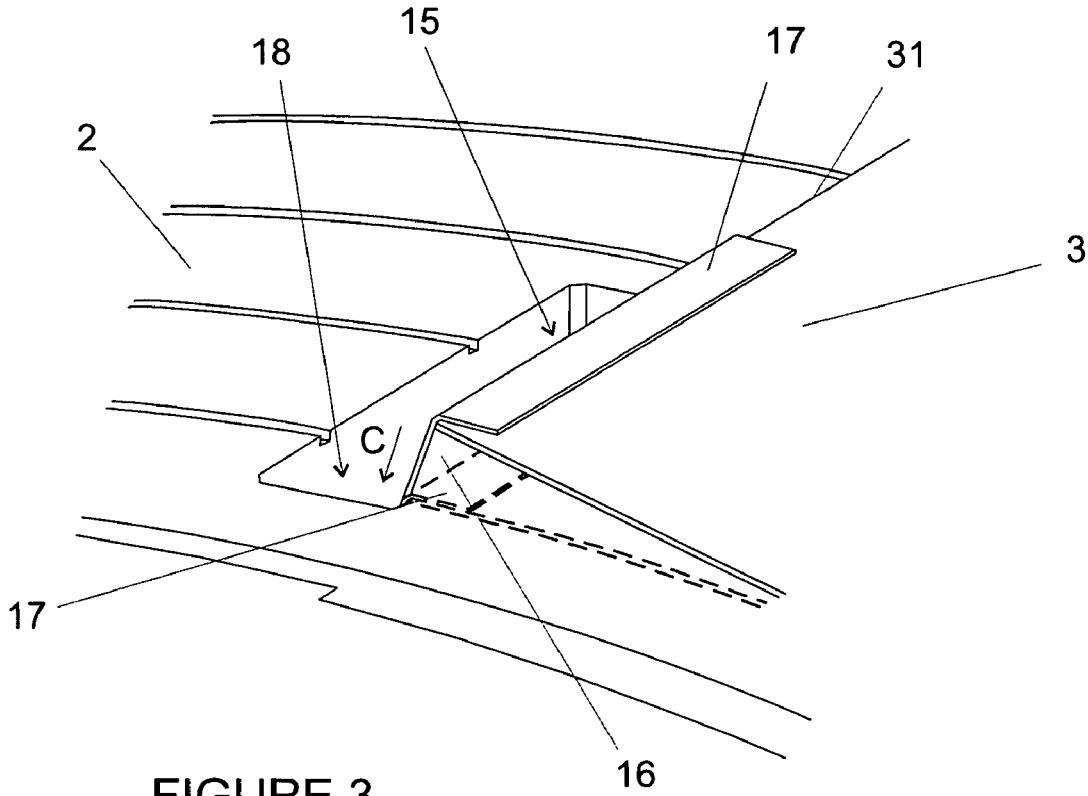
FIGS. 3 and 4 show a detail of the device of FIG. 2, in two steps of operation and in enlarged scale.

FIG. 3 shows an enlarged portion of the drum surface 2 having a recess 18, and a holder 15 in two different positions.

The position of the holder shown in solid lines is a media edge reception position. In this position, the leading edge 31 of a sheet of media 3, which is loaded onto the drum, abuts against the supporting plate 16 of the holder 15: this abutting contact constitutes a reference for positioning the print media on the surface of the drum 1, and at the same time it controls media skew.

A printing operation carried out by means of a printing drum and a holder according to embodiments of the invention is described in the following paragraphs.

A sheet of media 3 to be printed is fed to the rotating drum tangentially to the surface thereof and in the same direction, at a speed that preferably is slightly higher than the speed of the drum surface; in this operation, the leading edge 31 of the media 3 comes into contact with the supporting plate 16 of the holder 15. This contact, as stated above, allows positioning the sheet and controlling its skew.

After the drum has rotated a certain angle, and an increasing portion of the sheet has been brought in contact with the surface of the drum and thus with the hold-down system, the retention exerted by the hold-down system on the media has gradually increased, until the media is held firmly against the drum surface.

Throughout this operation the leading edge of the sheet is in contact with the supporting plate 16, such that control of the sheet position and the sheet skew may be performed during a relatively large interval of time; this makes the operation quite robust, such that it is relatively easy to meet the position and skew requirements.

The edge 31 of the sheet, however, tends to remain raised (as shown in solid lines in FIG. 3), since the hold-down force exerted on the sheet of media 3 is weaker at the media edges.

At this point, on subsequent rotation of the drum 1, the shape of the cams 5,6 causes the shaft 14 to be displaced downwards dragging or entraining the holders 15 along a direction shown by arrow C in FIG. 3, towards a clamping position in which the retaining lip 17 of the holder 15 traps the leading edge 31 of the sheet of media against the drum surface 2. This position is shown in dotted lines in FIG. 3.

Further rotation of the printing drum 1 brings the media under the printheads of the apparatus, for example ink jet printheads, and printing is performed on the media. It will be appreciated that before reaching the printheads and during printing the leading edge 31 of the media remains protected against the surface drum and under the retaining lip 17 of the holder 15, such that the risk of crashes of said edge with the printhead is avoided.

After the printing operation the device 4 releases the edge 31 of the media. This operation is shown in detail in FIG. 4, where the holder 15 is shown in solid lines in its clamping position (as described in relation to FIG. 3) and in dotted lines in its release position.

Figure 4:
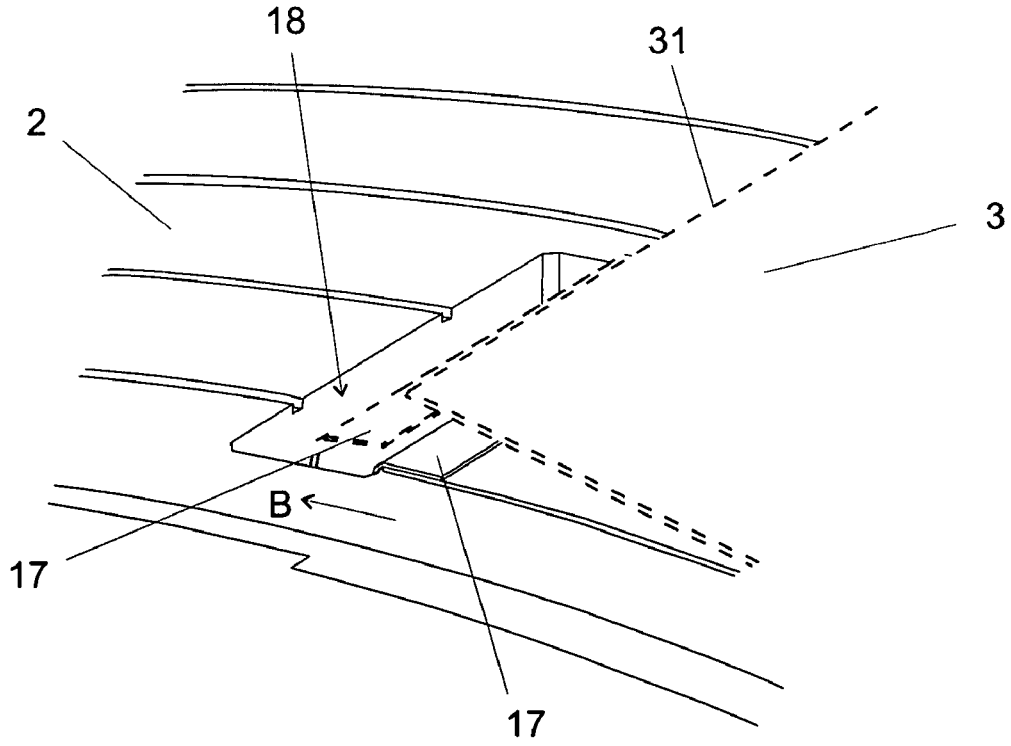

The movement from the clamping to the release position, in the direction indicated by arrow B in FIG. 4, is caused by the rotation of the shaft 14, to which the holders 15 are anchored, when the cam follower 19 rides on a lobe of the cam 21: the rotation of the shaft 14 slightly lifts and pulls back the retaining lip 17 of the holder 15 from the clamping position, and thus releases the media edge 31. A small rotation is enough for the purpose of releasing the media.

The sheet of print media is then discharged from the printing drum. This can be done by any known system, e.g. one that lifts the sheet from the surface of the drum to an extent that is enough for causing the loss of grip of the hold-down system on the media.

For subsequently restoring the holder 15 to the media edge reception position, the cams 5,6 and 21 have the appropriate shapes in order to cause a displacement of the blocks 9,10 and thus the shaft 14 in a direction opposite that of arrow C in FIG. 3 and a rotation of the shaft 14 in a direction opposite to that of arrow B in FIG. 4. However, other alternative movements could also be foreseen.

According to embodiments of the invention, the direction of the movement of the holder 15 from the media edge reception position to the clamping position is linear and is performed following a particular direction, as will be explained now with reference to FIG. 5.

Figure 5:
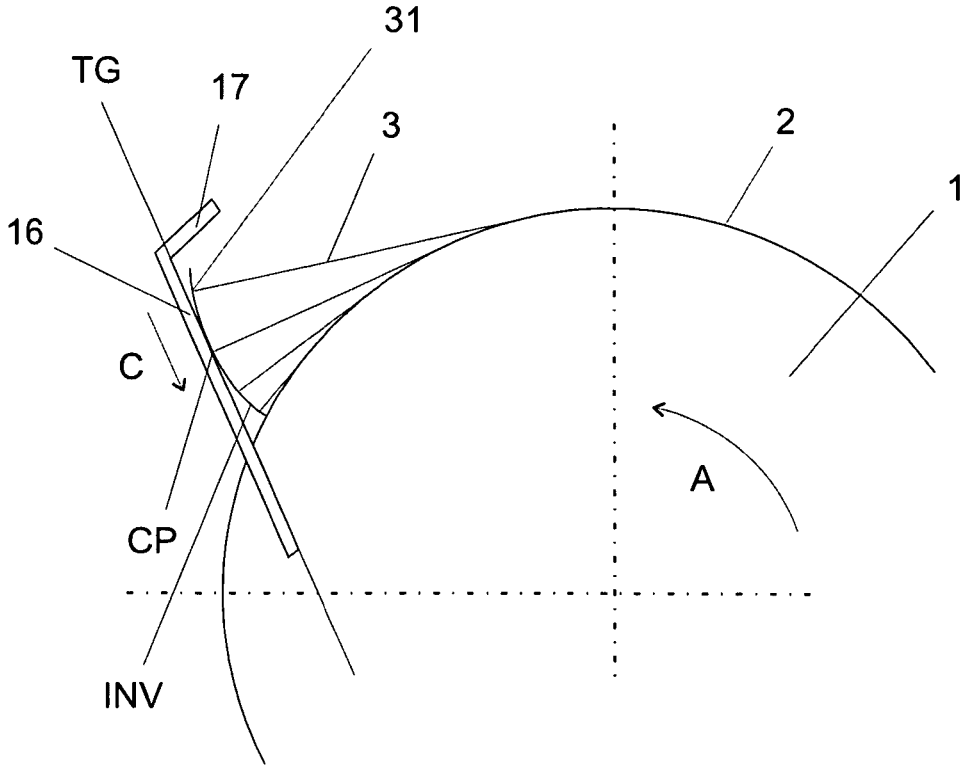
FIG. 5 illustrates the geometry and principle of operation of a device according to embodiments of the invention

FIG. 5 is a simplified diagram showing the involute curve INV followed by the edge 31 of the media 3 when it wraps on the surface 2 of the drum 1; the proportions have been greatly exaggerated, in order to make the diagram clearer. Furthermore, the L-shaped holder is shown in FIG. 5 with its retaining lip 17 forming an angle of more than 90° with respect to the supporting plate 16; this angle is appropriate so that the retaining lip remains relatively flat on the surface of the drum, and it has been exaggerated in FIG. 5 as a consequence of the distorted proportions of the figure. The direction of rotation of the drum is shown by arrow A.

In the present specification, by involute, or evolvent, it is meant the curve traced by a point of the edge of the sheet of media when it is wound or wrapped upon the drum surface without slipping.

The path defined or followed by any point of the edge of the print media when said edge is brought against the drum surface by the holder 15 is a section of the involute curve.

The edge 31 of the media abuts against the supporting plate 16 of the holder 15 in a contact point CP; according to embodiments of the present invention, the direction C in which the holder is displaced from the reception to the clamping position is parallel to the tangent TG to the involute curve INV at the contact point CP between the edge of media and the holder 15. It wilt be appreciated that the movement of the holder in direction C does not intersect the path defined by the edge of the print media during the movement of the holder.

According to other embodiments, the movement can be along a direction which is further sloped, with respect to the drum radius, than the tangent described above: in other words, a direction that is more spaced from the involute curve INV at the points below the contact point CP, i.e. between the contact point CP and the drum surface.

A direction such as described in the above embodiments prevents the holder 15 from "pushing back" the edge of media 31 during the movement, and therefore it does not cause bulges in the media, even if at the same time the sheet of media is held down on the drum surface by a vacuum system or the like.

In practice, the direction of the movement of the holder 15 will be designed for avoiding intersection with the path defined by the edge of the print media in the worse possible case, as explained in the following.

In the first place, the contact point between the supporting plate 16 and the edge of a sheet of media may be determined for the worse possible case, taking into account the design parameters of the drum, the media feeding speed, etc.

The reception position of the holder and the direction of its movement may then be designed and implemented for this point of contact ("worse-case point"), such as to avoid interference between the holder and the path of the media edge when the latter folds onto the drum surface entrained by the holder. This will normally involve setting the direction of movement of the holder along the tangent to the involute curve at said worse-case point.

In normal operation, with different kinds and speeds of media, the edge of each sheet of media will contact the supporting plate 16 of the holder either at the "worse-case point", or at any point below it; however, in all cases, the design guarantees that the holder will not intersect the path of the edge of the media during the movement towards the clamping position.

In fact, even if the edge of the media should contact the plate 16 at a point slightly higher than the "worse-case point" as determined, the device could work satisfactorily: in this case, the sheet would be temporarily pushed backwards during the movement of the holder, due to contact between the edge of the sheet and the holder supporting plate, thus temporarily forming a bulge; however, at the end of the travel of the holder the sheet would be released and the bulge would disappear before the holder reaches the clamping position, due to the shape of the involute curve.

An optional feature of the described device 4 is the possibility of fully concealing or withdrawing inside the drum recesses 18 the holders 15 associated to one or several shafts 14, during the whole rotation of the drum. This can be useful if the drum is provided with several shafts and holders, for different formats of media: when printing on large media formats the intermediate holders need to be maintained under the drum surface, in order to avoid projections from the drum surface in the region covered by the sheet of media.

The holders 15 of a shaft 14 may be concealed in the recesses 18 and under the level of the drum surface during all the rotation of the drum simply by disengaging the shaft 14 from the cam followers 7,8 and their movement.

Figure 6:
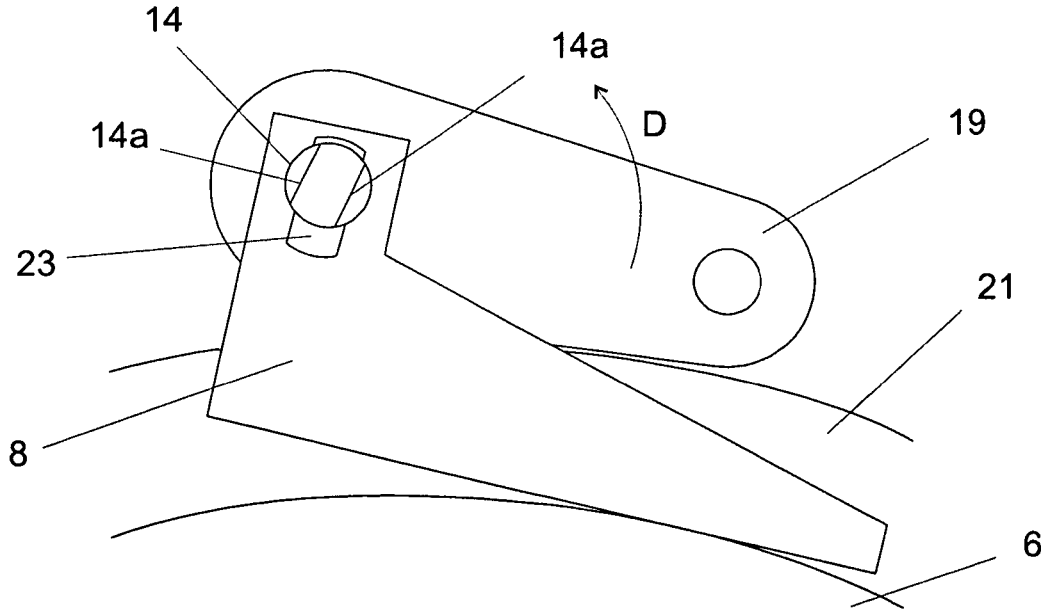
FIG. 6 illustrates a further aspect of the embodiment of FIG. 5.

As shown in FIG. 6, this can be carried out for example by providing two flat surfaces 14*a* at the ends of shaft 14, where the shaft is journalled in the cam followers 7,8, to define a narrowed shaft portion. The cam followers 7,8 are then provided with an elongate opening 23 having enough width for the passage of the narrowed shaft: by virtue of these features, there is an angular position of the shaft 14 with respect to the cam followers in which a movement of the cam followers in the direction of the elongate opening 23 will not entrain a corresponding movement of the shaft 14, because the latter will simply slide along the opening and remain stationary.

The rotation of the shaft to this position of disengagement with respect to the cam followers, beyond the rotation angle described above for releasing the media edge, is shown by arrow D in FIG. 6, and can be caused e.g. by an additional cam (not shown) which acts on cam follower 19 when necessary and which can be inactivated such as to remain spaced from the cam follower 19 when the holders do not need to be concealed. A displacement of the shaft 14 downwards can be also be foreseen, if appropriate, in order to ensure that the holders 15 remain under the level of the drum surface.

It must be noted that any of the movements of the holders 15 could also be operated by electric motors or by any other kind of mechanic and/or electric actuators, and is not necessarily associated to a cam system such as described herein.

Furthermore, even if the above embodiments have been described in relation with the leading edge of the media, a similar device could of course be applied to the trailing edge.

Embodiments of the device 4 for maintaining an edge of the print media against the surface of the drum as described above allow protecting the edge of the media during printing, by avoiding the risk of crashes against the printheads. It can also reduce the risk of defects in the printed plots, because the media is kept in contact with the drum also at its edges, so the distance to the printheads can be correctly maintained.

On the other hand, the abutment of the sheet against the holders 15 in several points along the width of the print media in the reception position of the holders can be used for providing skew correction without the need of using further devices.

Embodiments of the invention can thus simultaneously perform control of the leading edge position, thus providing an accurate reference for printing, control of the leading edge height on the drum surface, thus avoiding crashes and reducing printing defects, and control of the sheet skew.

The invention claimed is:

1. A device for maintaining an edge of a print media against a printing drum, said drum comprising a surface on which a print media is wrapped for printing thereon, wherein said device comprises at least one holder which comprises an abutment portion against which an edge of the media abuts before or during wrapping of the media on the drum surface, the holder being adapted to bring an upstanding portion of the media into contact with the drum surface by performing a movement with respect to the drum surface between a media edge reception position and a media edge clamping position, the movement of the holder from said reception position to said clamping position being performed in such a way that as the holder approaches the clamping position the distance between the edge of the media and the abutment portion of the holder increases, or remains substantially the same, thereby allowing the media in its clamping position to be substantially flat on the drum surface, wherein said holder is further movable with respect to the drum surface between the media edge clamping position and a media edge release position, the movement of said holder from said clamping position to said release position comprising a rotation in a direction away from the media sheet.

2. A device as claimed in claim 1, wherein the direction of movement of the holder from the reception position to the clamping position is linear.

3. A device as claimed in claim 2, wherein said direction of the movement from the reception position to the clamping position is parallel to the tangent, at a point of contact between the edge of media and the holder, to the involute curve described by the edge of the media during said movement, or more sloped than said tangent with respect to the direction of the drum radius at said contact point.

4. A device as claimed in claim 1, wherein said holder comprises an L-shaped part with a supporting plate defining the abutment portion, and further comprises a retaining lip, the direction of said movement from the reception position to the clamping position lying in the plane of the supporting plate.

5. A device as claimed in claim 1, wherein said holder is further movable with respect to the drum surface to a concealed position in which it remains flush with the drum surface or at a level under said surface.

6. A printing drum on which a print media is wrapped for printing thereon, said drum comprising a device as claimed in claim 1 for maintaining an edge of a print media against the drum surface.

7. A printing drum as claimed in claim 6, comprising at least two of said devices for maintaining an edge of a print media against the drum surface, said at least two devices being spaced apart about the circumference of the drum.

8. A printing drum as claimed in claim 7, wherein each of said at least two devices for maintaining an edge of a print media against the drum surface comprises at least one cam follower, said cam followers being driven by at least one common cam.

9. A printing apparatus comprising a printing drum on which a print media is wrapped for printing thereon, said printing apparatus further comprising a device as claimed in claim 1 for maintaining an edge of a print media against the drum.

10. A device for maintaining an edge of a print media against a printing drum, said drum comprising a surface on which a print media is wrapped for printing thereon, wherein said device comprises at least one holder which is movable with respect to the drum surface between a media edge reception position and a media edge clamping position, the movement of said holder from said reception position to said clamping position being performed in a direction which does not intersect the path of said media edge during said movement, and wherein said holder is further movable with respect to the drum surface between the media edge clamping position and a media edge release position, the movement of said holder from said clamping position to said release position comprising a rotation in a direction away from the media sheet.

11. A device for maintaining an edge of a print media against a printing drum, said drum comprising a surface on which a print media is wrapped for printing thereon, wherein said device comprises at least one holder which comprises an abutment portion against which an edge of the media abuts before or during wrapping of the media on the drum surface, and a common shaft on which are mounted at least two of said holders, said shaft being parallel to the edge of the media intended to be held against the printing drum, the holder being adapted to bring an upstanding portion of the media into contact with the drum surface by performing a movement with respect to the drum surface between a media edge reception position and a media edge clamping position, the movement of the holder from said reception position to said clamping position being performed in such a way that as the holder approaches the clamping position the distance between the edge of the media and the abutment portion of the holder increases, or remains substantially the same, thereby allowing the media in its clamping position to be substantially flat on the drum surface.

12. A device as claimed in claim 11, wherein said shaft is driven by at least one first cam and cam follower between said media edge reception position and said media edge clamping position of the holders.

13. A device as claimed in claim 12, wherein said shaft is driven by at least one second cam and cam follower between said media edge clamping position and a media edge release position of the holders.

14. A printing method, comprising:

providing a printing drum and a holder for maintaining an edge of said print media against said drum;

feeding a print media to said printing drum while maintaining said holder in a media edge reception position, at least until an edge of said media abuts said holder;

causing said holder to move to a clamping position to bring an upstanding portion of the media into contact with the drum surface, said movement being performed in a linear direction which does not intersect the path defined by the edge of the media during the movement;

providing a hold-down system for exerting on at least a portion of the print media other than the edges thereof a force tending to maintain said media against said drum surface; and wrapping a sheet of media on the drum surface while a hold-down system exerts a gradually increasing force on it, after abutment of the edge of the media against the holder and before movement of the holder to the clamping position; and printing on said print media.

* * * * *